US007220926B2

(12) United States Patent
Mano

(10) Patent No.: US 7,220,926 B2
(45) Date of Patent: May 22, 2007

(54) SWITCHING APPARATUS

(75) Inventor: Tomohiro Mano, Aichi (JP)

(73) Assignee: Kabushiki Kaisha Tokai Rika Denki Seisakusho, Aichi (JP)

( * ) Notice: Subject to any disclaimer, the term of this patent is extended or adjusted under 35 U.S.C. 154(b) by 0 days.

(21) Appl. No.: 11/488,091

(22) Filed: Jul. 18, 2006

(65) Prior Publication Data

US 2007/0017788 A1 Jan. 25, 2007

(30) Foreign Application Priority Data

Jul. 19, 2005 (JP) ..... P.2005-208507

(51) Int. Cl.
*H01H 15/06* (2006.01)

(52) U.S. Cl. ..... 200/16 D; 200/550

(58) Field of Classification Search .... 200/16 R–16 D, 200/537, 547, 549, 550, 252
See application file for complete search history.

(56) References Cited

U.S. PATENT DOCUMENTS 3,632,909 A * 1/1972 Rowley ..... 200/16 D
3,946,181 A * 3/1976 Takamizawa et al. ..... 200/531
4,001,526 A * 1/1977 Olson ..... 200/16 D
4,012,608 A * 3/1977 Lockard ..... 200/16 D
4,352,964 A * 10/1982 English ..... 200/5 A
4,491,703 A * 1/1985 Jaklic ..... 200/16 D
6,809,281 B2 * 10/2004 Miki ..... 200/529

FOREIGN PATENT DOCUMENTS

JP 2005-78838 3/2005

* cited by examiner

*Primary Examiner*—Michael A. Friedhofer
(74) *Attorney, Agent, or Firm*—Morgan, Lewis & Bockius

(57) ABSTRACT

A movable contact holder includes a rod-shaped portion which is formed in such a manner as to extend in a direction which is at substantially right angles to a traveling direction of a movable unit and is substantially parallel to a sliding plane of a movable contact, and the movable contact includes a folded-back piece portion which is folded back in such a manner as to extend along a circumferential side surface of the rod-shaped portion and is formed in such a manner as to be elastically deformable, whereby when a folded-back side surface of the folded-back piece portion turns around the circumferential side surface of the rod-shaped portion, the movable contact is assembled to the movable contact holder.

5 Claims, 5 Drawing Sheets

SWITCHING APPARATUS

BACKGROUND OF THE INVENTION

The present invention relates to a switching apparatus including a movable unit made up of a movable contact and a movable contact holder, the movable contact being assembled to the movable contact holder, and a plurality of stationary contacts arranged along a traveling direction of the movable unit in which grease is applied between the movable contact and the stationary contacts, and the movable contact slides on the plurality of stationary contacts in association with a reciprocating movement of the movable element along a direction in which the movable contact is assembled to the movable contact holder.

A switching apparatus of this type is configured as shown in FIG. 6. A switching apparatus 101 is configured so as to include a movable unit 102 and an insulator 103. The movable unit 102 is made up of a movable contact holder 104 and a movable contact 105, the movable contact 105 being assembled to the movable contact holder 104, and is made to reciprocate on the insulator 103 in directions indicated by arrows B1, B2 in FIG. 6. A plurality of stationary contacts 106*a* to 106*d* are arranged on the insulator 103 along the traveling direction of the movable unit 102. A control circuit (not shown) for controlling onboard equipment (not shown) is connected to these stationary contacts 106*a* to 106*d*. Then, in association with a movement of the movable unit 102 in the directions indicated by the arrows B1, B2 in FIG. 6, the movable contact 105 is designed to slide on the stationary contacts 106*a* to 106*d* in the directions indicated by the arrows B1, B2 in FIG. 6.

As this occurs, depending upon a position which the movable unit 102 has reached as a result of its traveling in the directions indicated by the arrows B1, B2 in FIG. 6, among the stationary contacts 106*a* to 106*d*, the stationary contacts with which the movable contact 105 is brought into sliding contact so as to energize are changed over, and the operation of the onboard equipment is designed to be changed over according to the stationary contact that is put in an energized state as a result of energization via the movable contact 105 (refer to JP-A-2005-078838, for example).

Incidentally, in the switching apparatus 101, the movable contact 105 is inserted into an insertion port 104*a* which is opened along the traveling direction of the movable unit 102 and is assembled to the movable contact holder 104 in such a state that the movable contact 105 is prevented from being dislodged by raised portions 104*b*. In addition, it is a general practice to apply grease (not shown) as a lubricant between the movable contact 105 and the stationary contacts 106*a* to 106*d*.

In this configuration, however, there exist the following problems.

While the grease is such as to have a function as a lubricant, in the event that temperature decreases, for example, there may occurs a case where the function as the lubricant is lost. In addition, in the event that the lubricating properties of the grease are lost, there may occur a case where the movable contact 105 securely sticks to the stationary contacts 106*a* to 106*d* side.

As this occurs, in production of a switching apparatus 101, for example, when attempting to remove the movable unit 102 from the insulator 103 in order to remount the movable unit 102, since there occurs a state where the movable contact 105 is pulled towards the insulator 103 side due to the tackiness of the grease, a force acts on the movable contact 105 in an opposite direction (the direction indicated by the arrow B1 in FIG. 6) to the direction in which the movable contact 105 is assembled to the movable contact holder 104. In addition, in a case where the switching apparatus 101 is actually used as a product, since the traveling direction of the movable unit 102 substantially coincides with the direction in which the movable contact 105 is assembled to the movable contact holder 104, when the movable unit 102 is caused to travel in the direction indicated by the arrow B2 in FIG. 6, the force acts, in this case, too, on the movable contact 105 in the opposite direction to the assembling direction of the movable contact 105 to the movable contact holder 104.

In addition, when the switching apparatus 101 is used for such a long period of time that grease is deteriorated, since there is generated a large frictional force or vibration between the movable contact 105 and the stationary contacts 106*a* to 106*d* during the travel of the movable unit 102, the force is also made to act on the movable contact 105 in the opposite direction to the assembling direction of the movable contact 105 to the movable contact holder 104 due to the effect of such a large frictional force or vibration.

Due to this, in the configuration described above in which the movable contact 105 is simply inserted into the insertion port 104*a* of the movable contact holder 104 so as to be prevented from being dislodged by the raised portions 104*b*, the movable contact 105 cannot resist the force acting thereon in the opposite direction to the assembling direction of the movable contact 105 to the movable contact holder 104 (a force acting in a direction in which the movable contact 105 is dislodged from the movable contact holder 104), resulting in a problem that the movable contact 105 is removed from the movable contact holder 104.

SUMMARY OF THE INVENTION

The invention has been made in view of the situations, and an object thereof is to provide a switching apparatus in which even in the event that the force acts on the movable contact in the opposite direction to the direction in which the movable contact is assembled to the movable contact holder due to the effect of the tackiness of grease or the large frictional force or vibration which is generated when the movable unit slides, the movable contact can hold the movable contact holder in a proper fashion, so as to accomplish an increase in quality.

In order to solve the object, the present invention is characterized by having the following arrangement.

(1) A switching apparatus comprising:

a plurality of stationary contacts arranged in a first direction;

a contact holder movable in the first direction, the contact holder including a rod-shaped portion extending in a second direction substantially perpendicular to the first direction and in substantially parallel with a sliding plane of the contact holder;

a movable contact assembled to the contact holder, the movable contact including a elastically deformable folded-back piece portion which is folded back in such a manner as to be wound around a circumferential side surface of the rod-shaped portion, and a sliding piece portion which slides on and contacts the plurality of stationary contacts with the movement of the contact holder; and grease applied between the sliding piece portion and the plurality of stationary contacts.

(2) The switching apparatus according to (1), wherein a cross section of the rod-shaped portion is formed into a circular shape.

(3) The switching apparatus according to (1), wherein a cross section of the rod-shaped portion is formed into a quadrangular shape.

(4) The switching apparatus according to (1), wherein a cross section of the rod-shaped portion is formed into a triangular shape.

(5) The switching apparatus according to (1), wherein the movable contact includes a bent piece portion which is formed by bending a distal end of the folded-back piece portion in an opposite direction to a direction in which the folded-back piece portion is folded back, and the bent piece portion is locked on a part of the contact holder so that the movable contact is assembled to the contact holder.

According to the switching apparatus of the first aspect of the invention, since the folded-back side surface of the folded-back piece portion is made to turn around the circumferential side surface of the rod-shaped portion of the movable contact holder, there is caused a state where the folded-back piece portion of the movable contact grabs the rod-shaped portion of the movable contact holder, whereby even in the event that the force acts on the movable contact in the opposite direction to the direction in which the movable contact is assembled to the movable contact holder due to the effect of the tackiness of grease applied between the movable contact and the stationary contacts or the large frictional force or vibration which is generated when the movable contact slides on the stationary contact, being from the conventional example, the movable contact can hold strongly the movable contact holder.

According to the switching apparatus of the second aspect of the invention, since the cross section of the rod-shaped portion which is at substantially right angles to the direction in which the rod-shaped portion extends is made into the circular shape, the circumferential side surface of the rod-shaped portion is formed into a curved surface, so that force can be made to act uniformly on the circumferential side surface of the rod-shaped portion of the movable contact holder from the folded-back side surface of the folded-back piece portion, whereby the movable contact can hold strongly the movable contact holder.

According to the switching apparatus of the third aspect of the invention, since the folded-back piece portion is made to be locked on part of the movable contact bolder, there is generated a state where the movable contact is supported on a locking position where the folded-back piece portion is locked on part of the movable contact holder, whereby the movable contact can be supported at such two locations as the rod-shaped portion of the movable contact holder and the locking position, so that the movable contact can be assembled to the movable contact holder in a stable state.

DETAILED DESCRIPTION OF PREFERRED EMBODIMENTS

Figure 1:
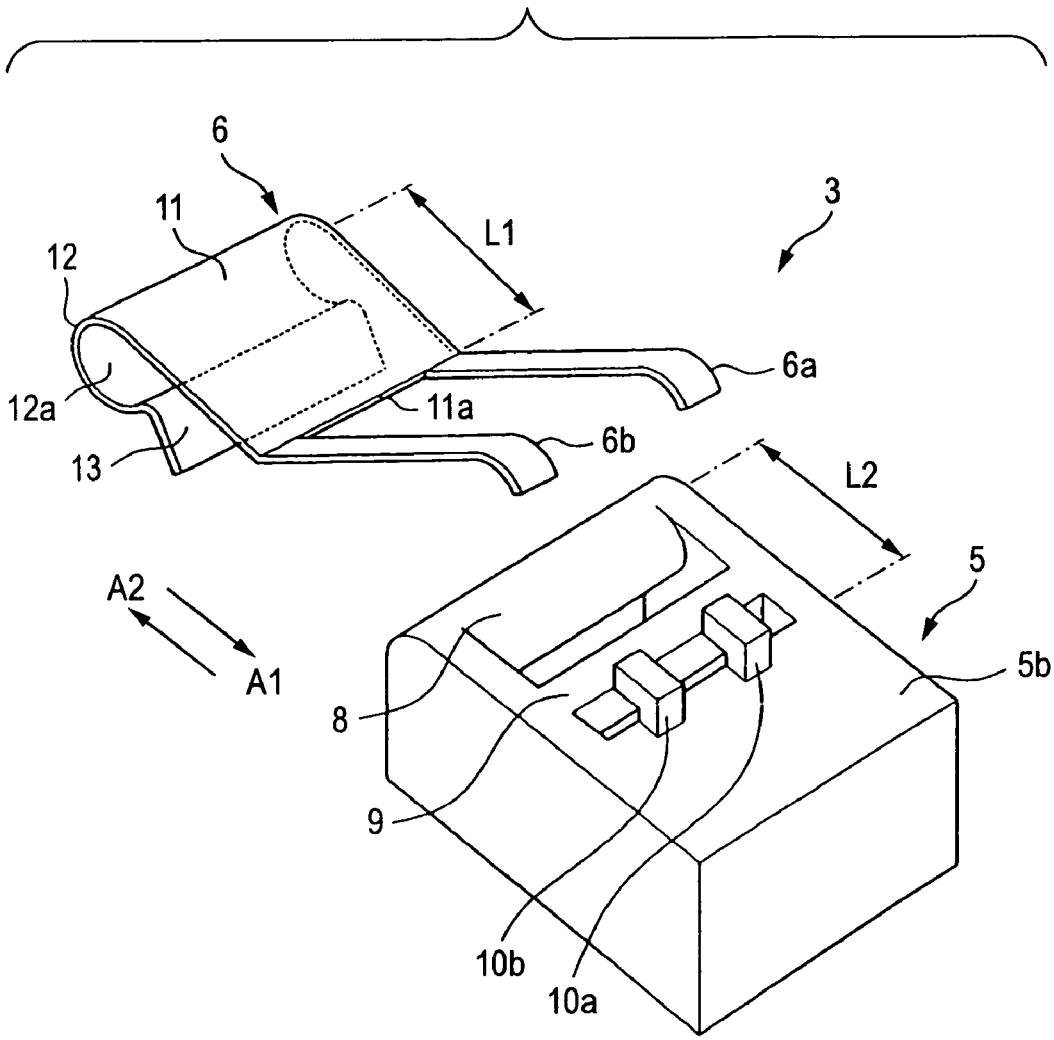
FIG. 1 is an external perspective view showing an embodiment of the invention, in which a movable contact and a movable contact holder are shown.
Figure 2:
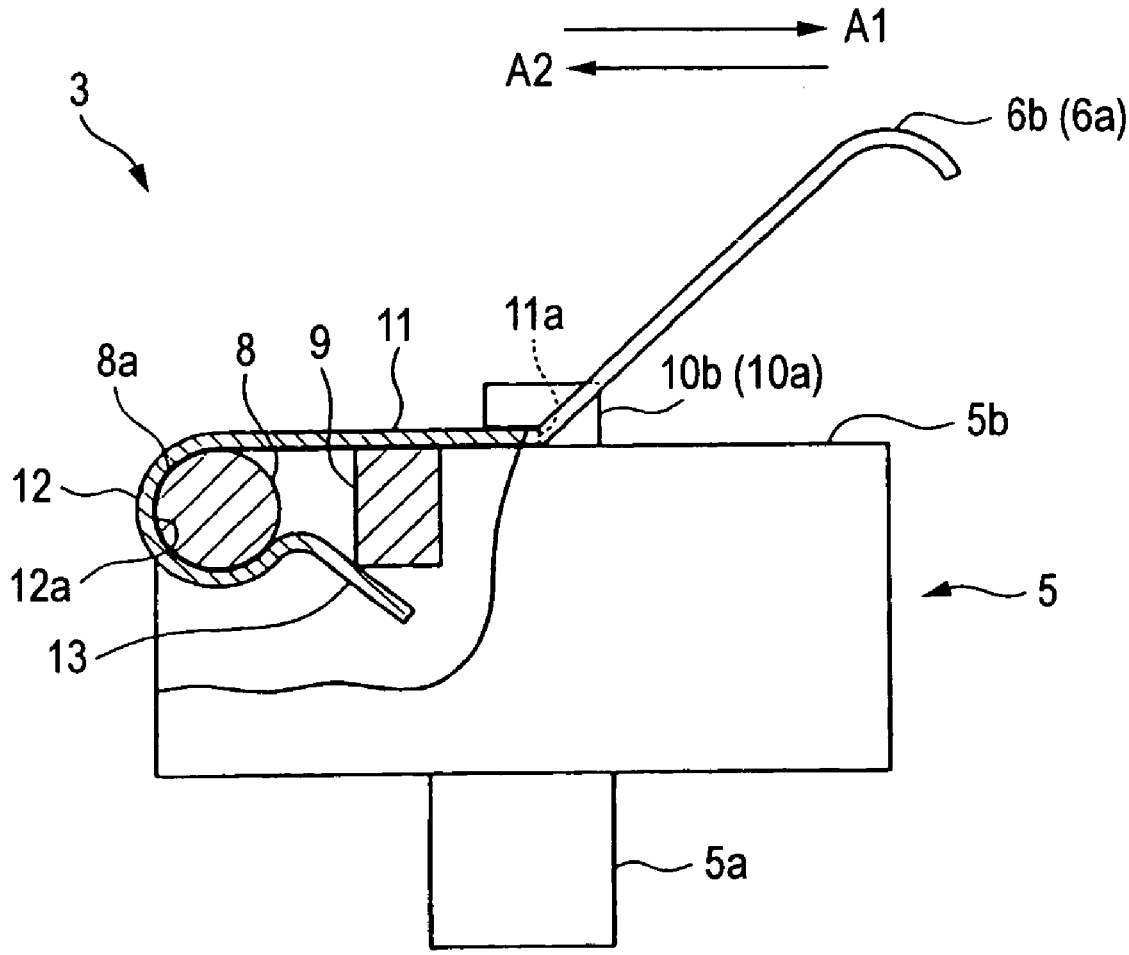
FIG. 2 is a side view showing a state where the movable contact is assembled to the movable contact holder with part cut away.
Figure 3:
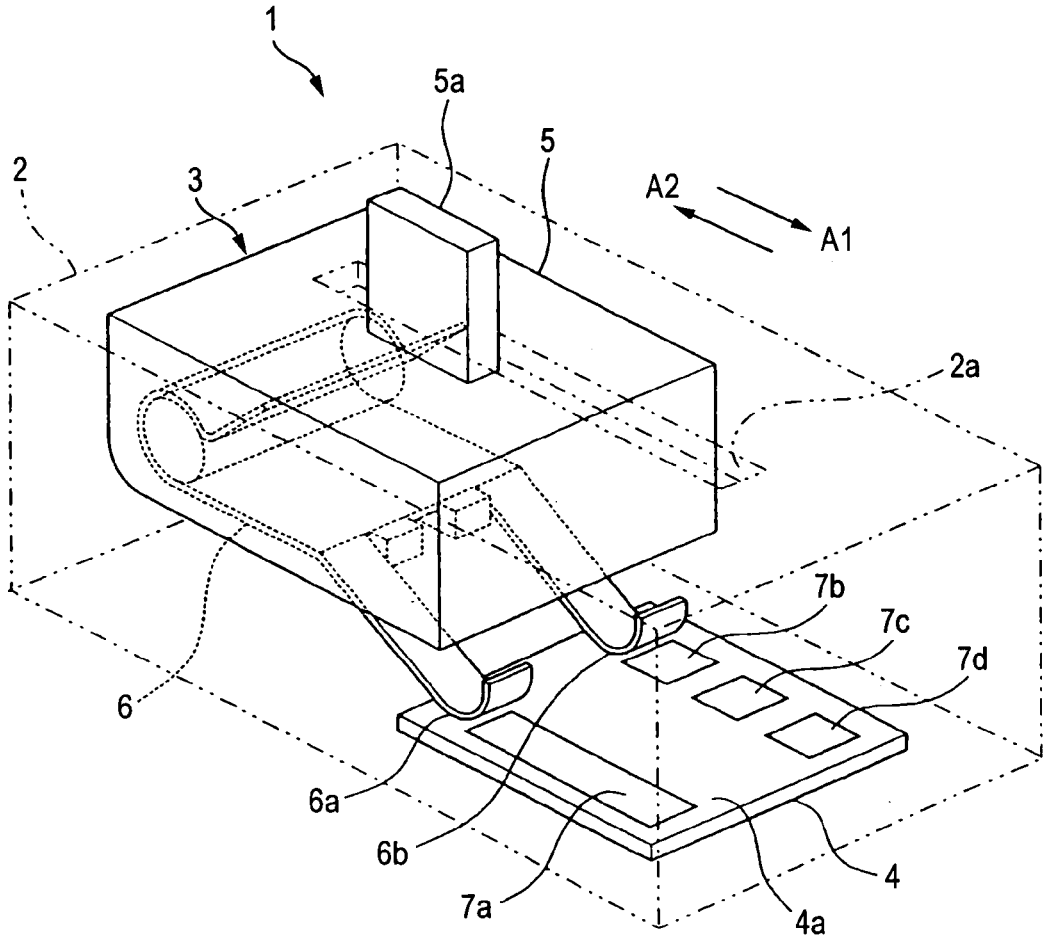
FIG. 3 is an external perspective view of a switching apparatus.

Hereinafter, an embodiment of the invention will be described by reference to FIGS. 1 to 3. In FIG. 3, a switching apparatus 1 is made up of a case 2, a movable unit 3 and an insulator 4.

The case 2 is formed into a rectangular box shape and a slide groove 2*a* is provided in an upper portion thereof in such a manner as to extend along a longitudinal direction of the case 2. The movable unit 3 is made up of a movable contact holder 5 and a movable contact 6 in such a state that the movable contact 6 is assembled to the movable contact holder 5. Details of the movable contact holder 5 and the movable contact 6 will be described later on. In addition, the movable unit 3 is provided in such a manner as to reciprocate in the case 2 in directions indicated by arrows A1, A1 in FIG. 3 in such a state that an operation lug 5*a* formed integrally with the movable contact bolder 5 is inserted in the slide groove 2*a*.

The insulator 4 is provided at a bottom portion inside the case 2. A plurality of stationary contacts 7*a* to 7*d* are arranged on an upper surface 4*a* of the insulator 4. Among these stationary contacts 7*a* to 7*d*, the stationary contact 7*a* is formed into an elongated shape in such a manner as to extend along a traveling direction of the movable unit, while the stationary contacts 7*b* to 7*d* are formed intermittently along a direction which is parallel to the stationary contact 7*a*. In addition, a control circuit (not shown) for controlling onboard equipment (not shown) is connected to these stationary contacts 7*a* to 7*d*.

Then, in association with the traveling of the movable unit 3 in the directions indicated by the arrows A, A2 in FIG. 3, a sliding piece portion of the movable contact 6 is designed to slide on the stationary contact 7*a* in the directions indicated by the arrows A1, A2 in FIG. 3, and at the same time as this occurs, a sliding piece portion 6*b* is designed to slide on the stationary contacts 7*b* to 7*d* in the directions indicated by the arrows A1, A2 in FIG. 3. Note that also in this switching apparatus 1, grease (not shown) as a lubricant is applied between the sliding piece portions 6*a*, 6*b* of the movable contact 6 and the stationary contacts 7*a* to 7*d*.

In addition, the movable unit 3 is designed to be locked by a click-stop mechanism (not shown) at positions where the sliding piece portion 6*b* is brought into sliding contact with the stationary contacts 7*b* to 7*d*, respectively. As this occurs, depending upon a position where the movable unit 3 is locked, among the stationary contacts 7*b* to 7*d*, the stationary contacts with which the sliding piece portion 6*b* of the movable contact 6 is brought into sliding contact for energization together with the stationary contact 7*a* are changed over, and the control circuit is designed to operate the onboard equipment in an operation pattern corresponding to the stationary contact that is put in an energized state as a result of energization via the sliding piece portion 6*b* of the movable contact 6. For example, when the stationary contact 7*a* and the stationary contact 7*b* are put in the energized state, the control circuit operates the onboard equipment in a first operation pattern, when the stationary contact 7*a* and the stationary contact 7*c* are put in the energized state, the control circuit operates the onboard equipment in a second operation pattern, and when the stationary contact 7*a* and the stationary contact 7*d* are put in the energized state, the control circuit operates the onboard equipment in a third operation pattern.

Next, the movable contact holder 5 and the movable contact 6, which have been described above, will be further described by reference to FIGS. 1 and 2, as well. FIG. 1 is an external perspective view which shows external appearances of the movable contact 6 and the movable contact holder 5, and FIG. 2 is a side view which shows a state where the movable contact 6 is assembled to the movable contact holder 5 with part cut away. Note that in FIGS. 1 and 2, for easy understanding of the description of the relevant portions, the movable unit 3 is shown with its side where the operation lug 5*a* is provided facing downwards.

Firstly, the shapes of the movable contact holder 5 and the movable contact 6 will be described, respectively. As shown in FIG. 1, a bottom surface 5*b* of the movable contact holder 5 is formed in such a manner as to be substantially parallel to a sliding plane (in other words, the upper surface 4*a* of the insulator 4) where the movable contact 6 slides on the stationary contacts 7*a* to 7*d*. In addition, a rod-shaped portion 8, a beam portion 9 and lug portions 10*a*, 10*b* are provided on the movable contact holder 5. The rod-shaped portion 8 is formed in such a manner as to extend in a direction which is at substantially right angles to directions indicated by arrows A1, A2 in FIG. 1 along which the movable unit 3 travels is substantially parallel to the bottom surface 5*b* (in other words, the sliding plane of the movable contact 6). In addition, a cross section (refer to FIG. 2)of the rod-shaped portion 8 which is at substantially right angles to the extending direction thereof is formed into a circular shape. Namely, a circumferential side surface 8*a* of the rod-shaped portion is formed into a curved surface. The beam portion 9 is formed in such a manner as to extend along the rod-shaped portion 8.

On the other hand, in addition to the aforesaid sliding piece portions 6*a*, 6*b*, a flat plane portion 11, a folded-back piece portion 12 and a bent piece portion 13 are provided on the movable contact 6. The flat plane portion 11 is formed into a flat plane shape which extends from a root portion of the sliding piece portions 6*a*, 6*b* towards the direction indicated by the arrow A2 in FIG. 1. A length L1 of the flat plane portion 11 in the directions indicated by the arrows A1, A2 in FIG. 1 is made substantially equal to a length L2 which extends from a root portion of the lug portions 10*a*, 10*b* to the rod-shaped portion 8 on the movable contact holder 5 in the directions indicated by the arrows A1, A2 in FIG. 1. The folded-back piece portion 12 is such as to be folded back so as to extend along the circumferential side surface 8*a* of the rod-shaped portion 8 when the movable contact 6 is assembled to the movable contact holder 5 and is formed in such a manner as to be elastically deformable. The bent piece portion 13 is formed by bending a distal end of the folded-back piece portion 12 in an opposite direction to the direction in which the folded-back piece portion 12 is folded back.

Next, a state where the movable contact 6 is assembled will be described. When the movable contact 6 is caused to travel in the direction indicated by the arrow A1 in FIG. 1 with respect to the movable contact holder 5, the bent piece portion 13 of the movable contact 6 is brought into abutment with the circumferential side surface 8*a* of the rod-shaped portion 8. When the movable contact 6 is caused to travel further in the direction indicated by the arrow A1 in FIG. 1 from this state, since the folded-back piece portion 12 is formed in such a manner as to be elastically deformable, a folded-back side surface 12*a* of the folded-back piece portion 12 fits on the rod-shaped portion 8 while being forcibly expanded in a smooth fashion as it travels along the curved surface shape of the circumferential side surface 8*a* of the rod-shaped portion 8. Then, the folded-back side surface 12*a* of the folded-back piece portion 12 eventually turns around the circumferential side surface 8*a* of the rod-shaped portion 8, as shown in FIG. 2. In addition, the bent piece portion 13 is locked on the beam portion 9 which is part of the movable contact holder 5. As this occurs, since the length L1 of the movable contact 6 side and the length L2 of the movable contact holder 5 side are made substantially equal to each other, an end portion 11*a* of the flat plane portion 11 of the movable contact 6 is hooked at the lug portions 10*a*, 10*b* on the movable contact holder 5

Next, as to the switching apparatus 1 that is configured as described above, a case is assumed where the lubricating properties of the grease are lost and the sliding piece portions 6*a*, 6*b* of the movable contact 6 are securely stuck to the stationary contacts 7*a* to 7*d* side.

In this case, in producing a switching apparatus 1, for example, when attempting to remove the movable unit 3 from the insulator 4 in order to remount the movable unit 3, since a state results where the movable contact 6 is pulled to the insulator 4 side due to the tackiness of the grease, a force acts on the movable contact 6 in an opposite direction (the direction indicated by the arrow A2 in FIG. 3) to the direction in which the movable contact 6 is assembled to the movable contact holder 5. In addition, in a case where the switching apparatus 1 is actually used as a product, since the traveling direction of the movable unit 3 substantially coincides with the assembling direction of the movable contact 6 onto the movable contact holder 5, when the movable unit 3 is caused to travel in the direction indicated by the arrow A1 in FIG. 3, a force acts on the movable contact 6 in the opposite direction to the assembling direction of the movable contact 6 onto the movable contact holder 5 due to the tackiness of the grease.

In addition, assuming a case where the switching apparatus 1 is used for such a long period of time that the grease is deteriorated, a force acts on the movable contact 6 in the opposite direction to the direction in which the movable contact 6 is assembled to the movable contact holder 5 due to the effect of a large frictional force or vibration generated between the sliding piece portions 6*a*, 6*b* and the stationary contacts 7*a* to 7*d* when the movable unit 3 travels.

With the switching apparatus 1 of the invention, however, since the folded-back side surface 12*a* of the folded-back piece portion 12 is made to turn around the circumferential side surface 8*a* of the rod-shaped portion 8 of the movable contact holder 5, a state results where the folded-back piece portion 12 of the movable contact 6 grabs the rod-shaped portion 8 of the movable contact holder 5. Consequently, even in the event that the force acts on the movable contact 6 in the opposite direction to the direction in which the movable contact 6 is assembled to the movable contact holder 5, the movable contact 6 holds the movable contact holder 5 in such a manner that the folded-back piece portion 12 grabs the rod-shaped portion. In addition, since the circumferential side surface 8*a* of the rod-shaped portion 8 is formed into the curved surface shape, the folded-back side surface 12*a* of the folded-back piece portion 12 allows force to be applied uniformly to the circumferential side surface 8*a* of the rod-shaped portion 8 of the movable contact holder 5.

Furthermore, since the bent piece portion 13 is made to be locked on the beam portion 9, a state results where the movable contact 6 is supported at a locking position where the bent piece portion 13 is locked on the beam portion 9.

While the case has been described heretofore where the force acts on the movable contact 6 in the opposite direction to the direction in which the movable contact 6 is assembled to the movable contact holder 5, there may exist a case where due to the effect of the force acting in this direction, a force also acts on the movable contact 6 in another direction (for example, a direction perpendicular to the direction in which the movable contact 6 is assembled to the movable contact holder 5). With the switching apparatus 1 of the invention, however, since the end portion 11*a* of the flat plane portion 11 is caught at the lug portions 10*a*, 10*b*, even in the event that the force acts on the movable contact 6 in the direction perpendicular to the direction in which the movable contact 6 is assembled to the movable contact holder 5, the flat plane portion 11 is held to the bottom surface 5*b* side by the lug portions 10*a*, 10*b*.

As has been described heretofore, according to the embodiment of the invention, since the folded-back side surface 12*a* of the folded-back piece portion 12 is made to turn around the circumferential side surface 8*a* of the rod-shaped portion 8 on the movable contact holder 5, the state results where the folded-back piece portion 12 of the movable contact 6 grabs the rod-shaped portion 8 of the movable contact holder 5, whereby even in the event that the force acts on the movable contact 6 in the opposite direction to the direction in which the movable contact 6 is assembled to the movable contact holder 5 due to the tackiness of the grease applied between the movable contact 6 and the stationary contacts 7*a* to 7*d* or the effect of the large frictional force or vibration generated when the movable contact 6 slides on the stationary contacts 7*a* to 7*d*, being different from the conventional examples, the movable contact 6 can hold the movable contact holder 5 in a proper fashion, thereby making it possible to accomplish an increase in quality.

In addition, since the cross section of the rod-shaped portion 8 which is at substantially right angles to the direction in which the rod-shaped portion 8 extends is formed into the circular shape, the circumferential side surface 8*a* of the rod-shaped portion 8 is formed into the curved surface shape, the force can be applied uniformly from the folded-back side surface 12*a* of the folded-back piece portion 12 to the circumferential side surface 8*a* of the rod-shaped portion 8 of the movable contact holder 5, thereby making it possible that the movable contact 6 can hold strongly the movable contact holder 5. In addition, when assembling the movable contact 6 to the movable holder 5, since the folded-back piece portion 12 is forcibly expanded in a smooth fashion along the circumferential side surface 8*a* of the rod-shaped portion 8, the assembly of the movable contact 6 can be facilitated.

Additionally, since the bent piece portion 13 is made to be locked on the beam portion 9 which makes up part of the movable contact holder 5, the state results where the movable contact 6 is supported at the locking position between the bent piece portion 13 and the beam portion 9, whereby the movable contact 6 can be supported at two locations, the rod-shaped portion 8 and the beam portion 9, on the movable contact holder 5, thereby making it possible to assemble the movable contact 6 to the movable contact holder 5 in a stable state.

In addition, even in the event that the force acts on the movable contact 6 in the direction perpendicular to the direction in which the movable contact 6 is assembled to the movable contact holder 5, since the flat plane portion 11 is held to the bottom surface 5*b* side by the lug portions 10*a*, 10*b*, the expansion of the folded-back piece portion 12 can be prevented which would otherwise be generated due to the flat plane portion 11 of the movable contact 6 warping up from the bottom surface 5*b* of the movable contact holder 5, whereby the holding force of the movable contact 6 is weakened in no case.

The invention is not limited only to the embodiment that has been described heretofore and hence can be modified or expanded in the following manner.

Figure 4:
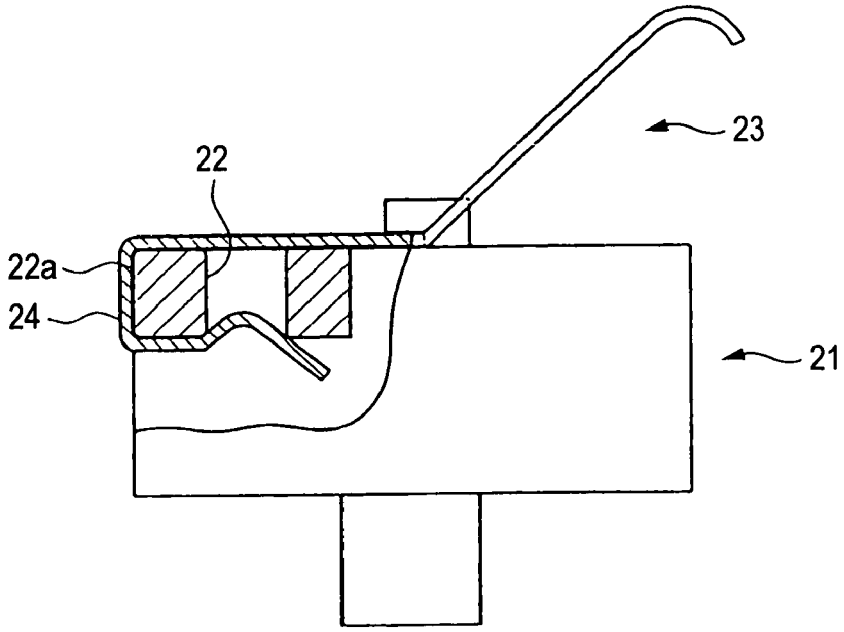
FIG. 4 is aside view showing another embodiment of the invention, which shows a state where a movable contact is assembled to a movable contact holder with part cut away.

The cross section of the rod-shaped portion is not limited to such a circular shape as one described with respect to the rod-shaped portion 8, and as shown in FIG. 4, a configuration may be adopted in which a cross section of a rod-shaped portion 22 of a movable contact holder 21 is formed into a quadrangular shape and a folded-back piece portion 24 of a movable contact 23 is folded back into a quadrangular shape in such a manner as to follow a circumferential side surface 22*a* of the rod-shaped portion 22 and is formed in such a manner as to be elastically deformable.

Figure 5:
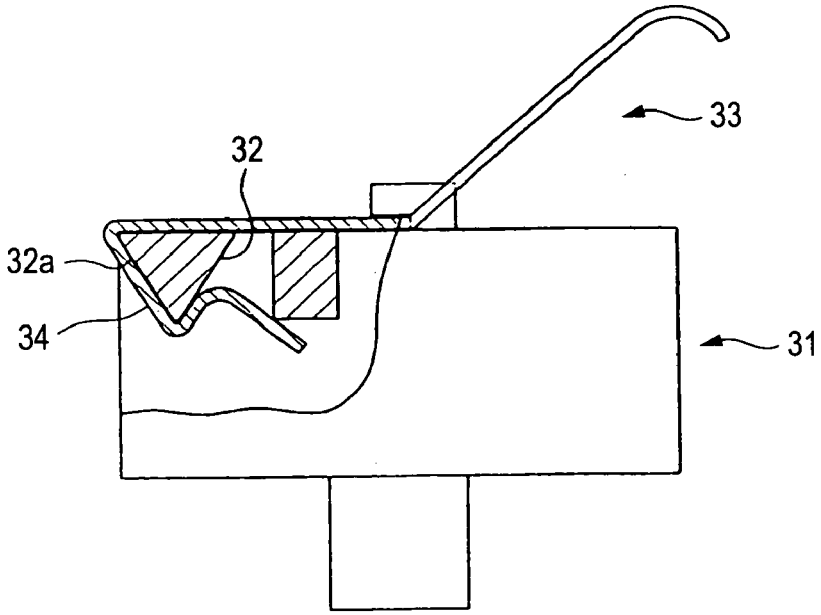
FIG. 5 is a view corresponding to FIG. 4.
Figure 6:
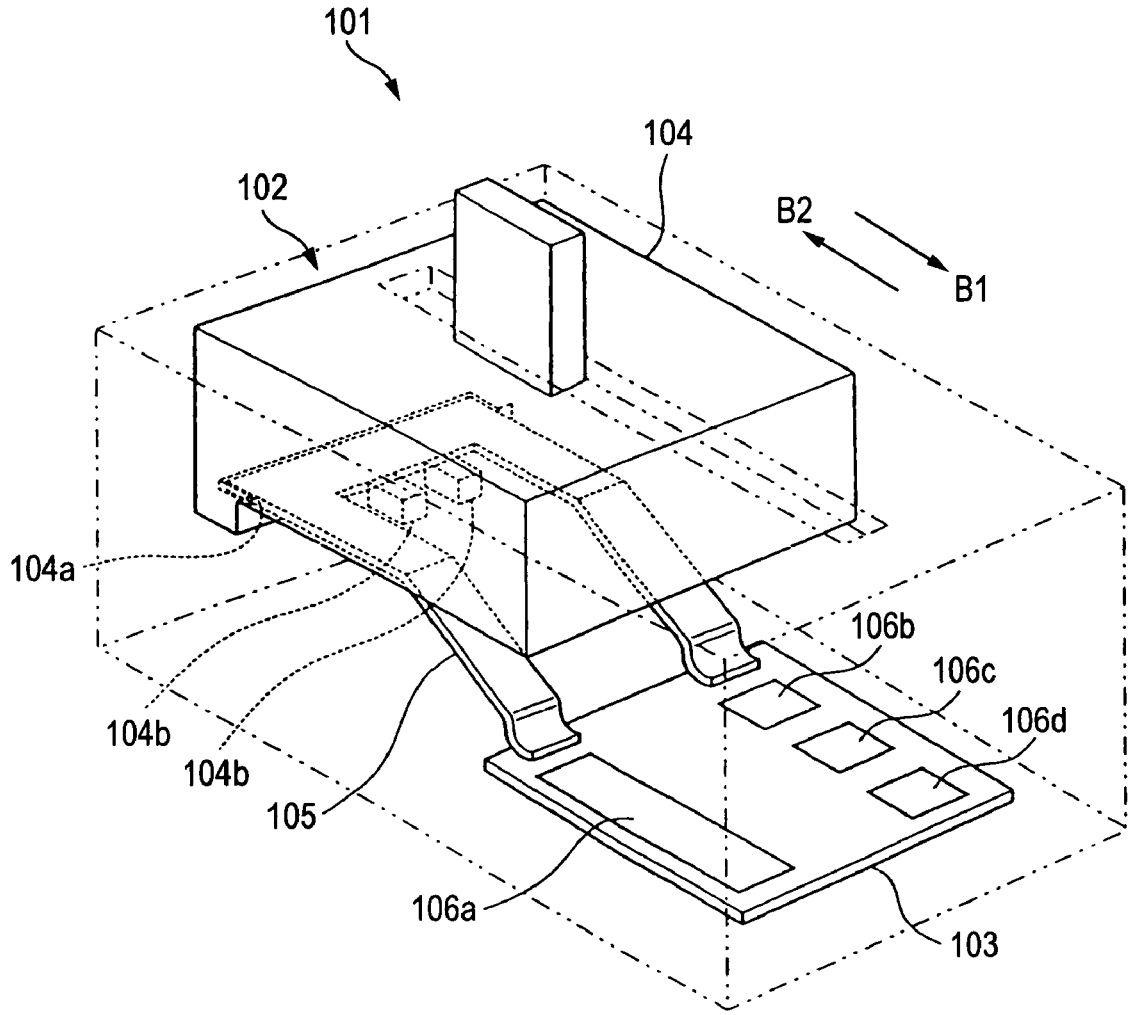
FIG. 6 is an external perspective view showing a conventional configuration.

In addition, as shown in FIG. 5, a configuration may be adopted in which a cross section of a rod-shaped portion 32 of a movable contact holder 31 is formed into a triangular shape and a folded-back piece portion 34 of a movable contact 33 is folded back into a triangular shape in such a manner as to follow a circumferential side surface 32*a* of the rod-shaped portion 32 and is formed in such a manner as to be elastically deformable. Furthermore, although not shown, the shape of the cross section of the rod-shape portion and the shape into which the folded-back piece portion is folded back may be of other shapes.

The movable unit 3 is not limited to such as to travel rectilinearly, and hence a movable unit may be adopted which rotates in a arc-like shape.

As onboard equipment to which the switching apparatus 1 of the invention can be applied, an automotive wiping system can be raised, for example. In this event, the movable unit 3 may only have to be designed to travel according to a position to which an operation stalk of an automotive wiper switch. In addition, the switching apparatus of the invention can also be applied to a turn signal switch or an automatic transmission switch, and in this event, the movable unit 3 may only have to be designed to travel while interlocking with an operating element of each of the onboard equipment.

What is claimed is:

1. A switching apparatus comprising:

a plurality of stationary contacts arranged in a first direction;

a contact holder movable in the first direction, the contact holder including a rod-shaped portion extending in a second direction substantially perpendicular to the first direction and substantially parallel with a sliding plane of the contact holder;

a movable contact assembled to the contact holder, the movable contact including an elastically deformable folded-back piece portion which is folded back in such a manner as to be wound around a circumferential side surface of the rod-shaped portion, and a sliding piece portion which slides on and contacts the plurality of stationary contacts with the movement of the contact holder; and wherein the contact holder includes a plurality of operation lugs located on a bottom surface of the contact holder and extending perpendicularly from the bottom surface to engage a flat plane portion of the movable contact abutting the bottom surface; and grease applied between the sliding piece portion and the plurality of stationary contacts.

2. The switching apparatus according to claim 1, wherein a cross section of the rod-shaped portion is formed into a circular shape.

3. The switching apparatus according to claim 1, wherein a cross section of the rod-shaped portion is formed into a quadrangular shape.

4. The switching apparatus according to claim 1, wherein a cross section of the rod-shaped portion is formed into a triangular shape.

5. A switching apparatus comprising:

a plurality of stationary contacts arranged in a first direction;

a contact holder movable in the first direction, the contact holder including a rod-shaped portion extending in a second direction substantially perpendicular to the first direction and substantially parallel with a sliding plane of the contact holder;

a movable contact assembled to the contact holder, the movable contact including an elastically deformable folded-back piece portion which is folded back in such a manner as to be wound around a circumferential side surface of the rod-shaped portion, and a sliding piece portion which slides on and contacts the plurality of stationary contacts with the movement of the contact holder;

grease applied between the sliding piece portion and the plurality of stationary contacts;

wherein the movable contact includes a bent piece portion which is formed by bending a distal end of the folded-back piece portion in an opposite direction to a direction in which the folded-back piece portion is folded back, and the bent piece portion is locked on a part of the contact holder so that the movable contact is assembled to the contact holder.

* * * * *